US007819265B2

(12) United States Patent
Brozell

(10) Patent No.: US 7,819,265 B2
(45) Date of Patent: Oct. 26, 2010

(54) CHILD-RESISTANT CLOSURE AND CONTAINER PACKAGE

(75) Inventor: Brian J. Brozell, Maumee, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 1072 days.

(21) Appl. No.: 11/447,633

(22) Filed: Jun. 6, 2006

(65) Prior Publication Data

US 2007/0278173 A1 Dec. 6, 2007

(51) Int. Cl.
*B65D 55/02* (2006.01)
*B65D 41/06* (2006.01)
*B65D 41/36* (2006.01)

(52) U.S. Cl. ..... 215/222; 215/332; 215/344

(58) Field of Classification Search ..... 215/222, 215/332, 344, 216, 219
See application file for complete search history.

(56) References Cited

U.S. PATENT DOCUMENTS

| | | | | |
|---|---|---|---|---|
| 3,339,770 | A | 9/1967 | Weigand | |
| 3,435,975 | A * | 4/1969 | Weigand | 215/214 |
| 3,822,811 | A | 7/1974 | Landen | |
| 3,880,313 | A * | 4/1975 | Akers | 215/211 |
| 3,927,783 | A | 12/1975 | Bogert | |
| 3,951,289 | A | 4/1976 | Landen | |
| 4,049,148 | A | 9/1977 | Suhr et al. | |
| RE30,625 | E | 5/1981 | Akers | |
| 4,320,844 | A | 3/1982 | Cooper | |
| 4,373,641 | A | 2/1983 | Banich, Sr. et al. | |
| 4,383,618 | A * | 5/1983 | Dougherty | 215/216 |
| 4,387,817 | A | 6/1983 | Wiles et al. | |
| 4,444,327 | A | 4/1984 | Hedgewick | |
| 4,526,281 | A * | 7/1985 | Herr | 215/211 |
| 4,579,238 | A | 4/1986 | Herr | |
| 4,620,640 | A | 11/1986 | Swartzbaugh | |
| 4,739,890 | A * | 4/1988 | Cooke | 215/222 |
| 5,135,124 | A | 8/1992 | Wobser | |
| 5,449,078 | A | 9/1995 | Akers | |
| 5,738,231 | A * | 4/1998 | Montgomery | 215/44 |
| 6,227,391 | B1 | 5/2001 | King | |
| 6,354,450 | B1 | 3/2002 | Zielinski et al. | |
| 6,378,713 | B2 | 4/2002 | Montgomery | |
| 6,397,499 | B1 * | 6/2002 | Savoie | 36/134 |
| 7,527,159 | B2 * | 5/2009 | Brozell | 215/222 |
| 2001/0019033 | A1 | 9/2001 | Montgomery | |
| 2003/0121877 | A1 | 7/2003 | Brozell et al. | |
| 2004/0007556 | A1 | 1/2004 | Manera et al. | |
| 2004/0173562 | A1 | 9/2004 | Wolfe | |
| 2005/0263477 | A1 * | 12/2005 | Konefal et al. | 215/228 |
| 2005/0269280 | A1 | 12/2005 | Konefal et al. | |

FOREIGN PATENT DOCUMENTS

| | | |
|---|---|---|
| DE | 2332339 | 1/1974 |

* cited by examiner

*Primary Examiner*—Anthony Stashick
*Assistant Examiner*—Madison L Wright
(74) *Attorney, Agent, or Firm*—Reising Ethington PC

(57) ABSTRACT

A child-resistant package includes a container having a neck finish with an open mouth, an angularly spaced array of external projections with notches on undersides of the projections, and a conical internal surface around the mouth. A closure has a base wall, a first annular wall with angularly spaced internal lugs received within the notches, and a second annular wall disposed radially inwardly from the first annular wall and in resilient sealing engagement with the internal surface on the container neck finish.

8 Claims, 3 Drawing Sheets

CHILD-RESISTANT CLOSURE AND CONTAINER PACKAGE

The present disclosure relates to child-resistant closure and container packages, such as medication packages for example, and to closures and containers for such packages.

BACKGROUND AND SUMMARY OF THE DISCLOSURE

The present disclosure relates to push-and-turn child-resistant packages of the type in which internal lugs on a closure skirt are received in pockets on the undersides of external projections on the container neck finish, and in which the closure is biased by one or more spring elements to retain the lugs in the pockets. Axial pressure on the closure against the force of the spring element(s) and simultaneous turning of the closure with respect to the container permits removal of the closure from the container neck finish. Packages of this type conventionally are employed for prescriptions, vitamins and other medications, and for a number of other applications such as laundry products. See, for example, U.S. Pat. Nos. 4,057,159, 4,059,198 and 4,485,932. The present disclosure relates to improvements in such packages, and to closures and containers for such packages, that facilitate automated application of the closure to the container neck finish.

The present disclosure embodies a number of aspects that can be implemented separately from or in combination with each other.

A child-resistant package in accordance with one aspect of the present disclosure includes a container having a neck finish with an open mouth, an angularly spaced array of external projections with notches on undersides of the projections, and a conical internal surface around the mouth. A closure has a base wall, a first annular wall with angularly spaced internal lugs received within the notches, and a second annular wall disposed radially inwardly from the first annular wall and in resilient sealing engagement with the internal surface on the container neck finish. The second annular wall has a substantially cylindrical portion adjacent to the base wall and a conical portion extending from the cylindrical portion at an angle inwardly from the first annular wall and away from the base wall. The conical portion of the second annular wall has an edge remote from the base wall that is spaced from the internal surface of the container neck finish. This angulated free edge of the second annular wall helps prevent interference between the second annular wall and the container mouth during automated application of the closure to the container neck finish.

A child-resistant closure in accordance with another aspect of the disclosure includes a one-piece molded plastic shell having a base wall, a first annular wall with angularly spaced internal lugs and a second annular wall disposed radially inwardly from the first annular wall. The second annular wall as molded has a cylindrical portion adjacent to the base wall, and a conical portion extending from the cylindrical portion and at an angle inwardly from the first annular wall and away from the base wall. The internal lugs on the first annular wall preferably have convex radially inwardly facing surfaces. Each of these surfaces has a clockwise edge and a counterclockwise edge as viewed from the base wall of the closure. The clockwise edge of the surface preferably is closer than the counterclockwise edge to an inside surface of the first annular wall. The radially inwardly facing surface of each lug preferably has a first portion with a uniform radius of curvature from the clockwise edge to a position adjacent to but spaced from the counterclockwise edge, and a second portion that is flat from said first portion to said counterclockwise edge. This lug surface configuration facilitates automated application of the closure to a container neck finish.

A molded plastic container in accordance with a further aspect of the present disclosure includes a neck finish having an open mouth, an angularly spaced array of external projections with notches on undersides of the projections, and a conical internal surface around the mouth. The conical internal surface has a first portion adjacent to the mouth and a second portion extending from the first portion. The second portion is at an angle greater than the first portion with respect to an axis of the container neck finish. This surface configuration is adapted to cooperate with a spring/seal wall on the closure to bias the closure away from the container neck finish when the closure is over-applied to a container neck finish.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
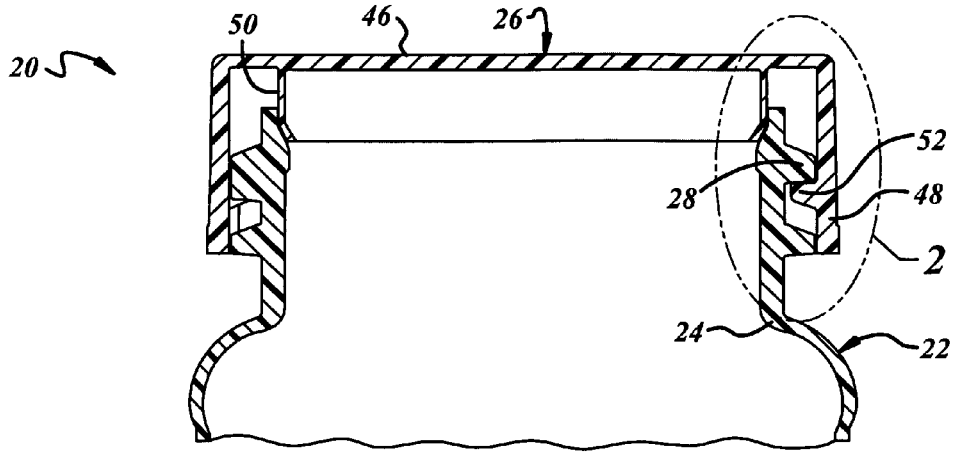
FIG. 1 is a fragmentary sectional view of a closure and container package in accordance with an exemplary embodiment of the present disclosure.
Figure 2:
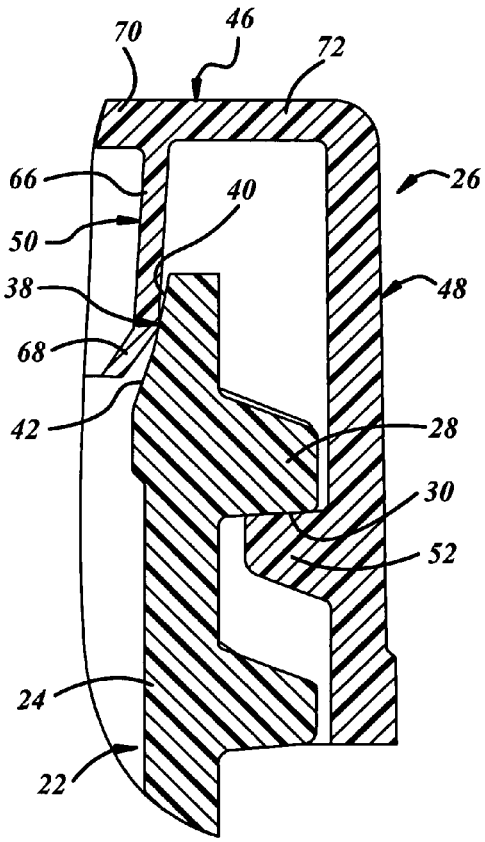
FIG. 2 is an enlarged view of the portion of FIG. 1 within the area 2.

FIGS. 1-2 illustrate a closure and container package 20 in accordance with an exemplary embodiment of the present disclosure. Package 20 includes a container 22 having a neck finish 24 with a closure 26 secured thereto. Container 22 and closure 26 preferably are each of one-piece molded plastic construction.

Figure 3:
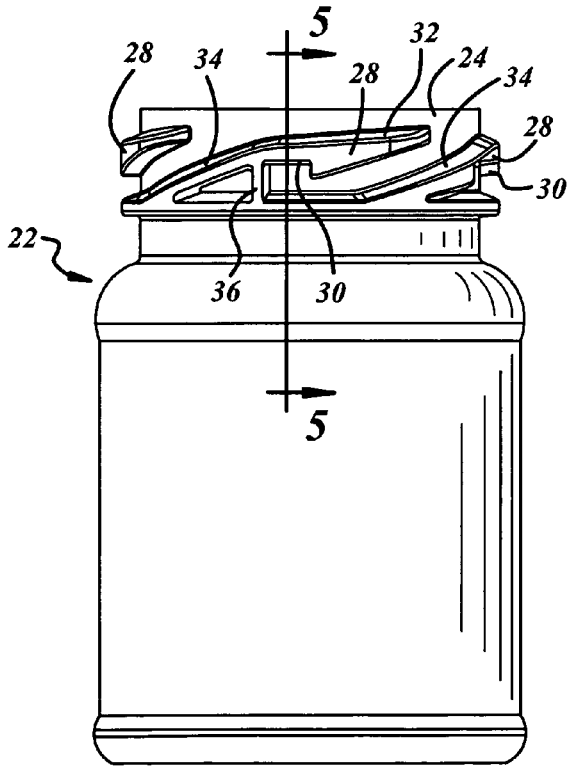
FIG. 3 is an elevational view of the container in the package of FIGS. 1 and 2.
Figure 4:
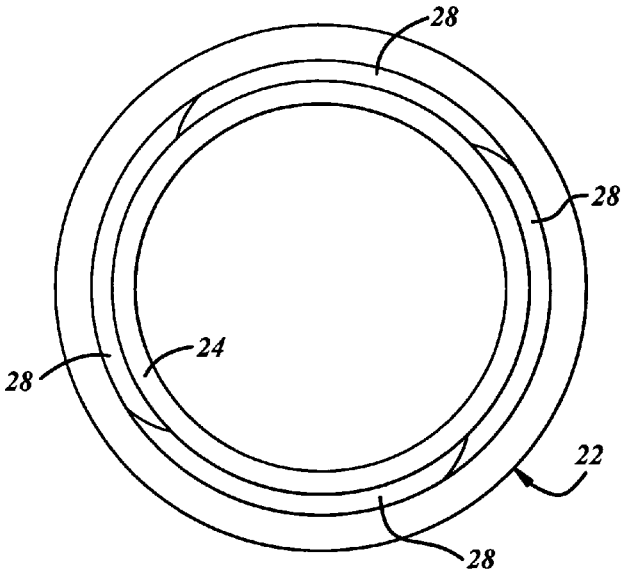
FIG. 4 is a top plan view of the container in FIG. 3.
Figure 5:
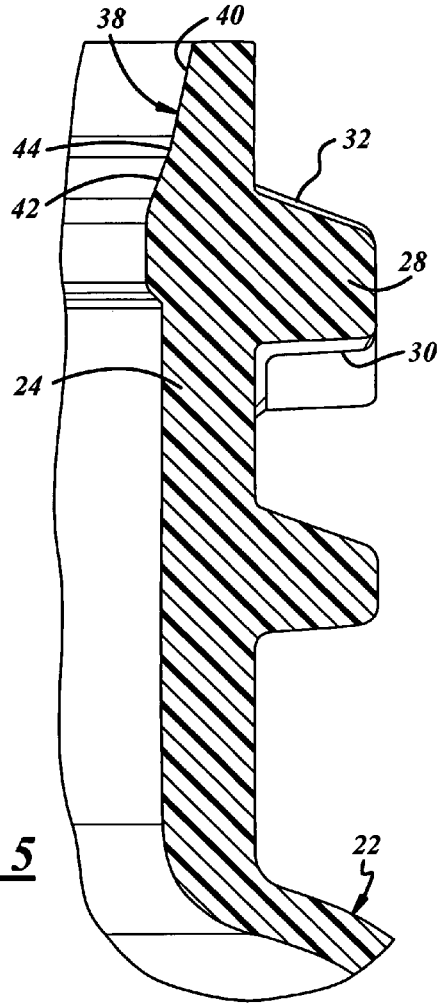
FIG. 5 is a fragmentary sectional view taken substantially along the line 5-5 in FIG. 3.

Container 22 is illustrated in greater detail in FIGS. 3-5. Neck finish 24 has an open mouth and a plurality of angularly spaced external projections 28. Each external projection 28 has an underside with a notch 30. The upper edge of each projection 28 includes a first portion 32 at a slight helical angle with respect to the axis of the neck finish, and a second portion 34 partially underlying the adjacent projection 28 and at a greater helical angle to the axis of the neck finish. A wall 36 extends axially adjacent to each notch 30 to function as a stop against over-application of the closure to the neck finish. Neck finish 24 also has an internal conical surface 38 adjacent to the container mouth. Internal surface 38 is a compound surface that includes a first conical portion 40 at the open end of the container mouth and a second conical portion 42 that extends from first portion 40. As best seen in FIG. 5, second portion 42 is at a greater angle to the axis of the container neck finish than is the first portion 40. Surface portions 40,42 are connected to each other by a concave surface portion 44. By way of example only, first conical surface portion 40 may be at an angle of about 12° to the axis of the neck finish and second conical surface portion 42 at an angle of about 20°. This greater angle at surface portion 42 helps closure 26 to "spring back" away from the neck finish and facilitates automated application of the closure to the neck finish.

Figure 6:
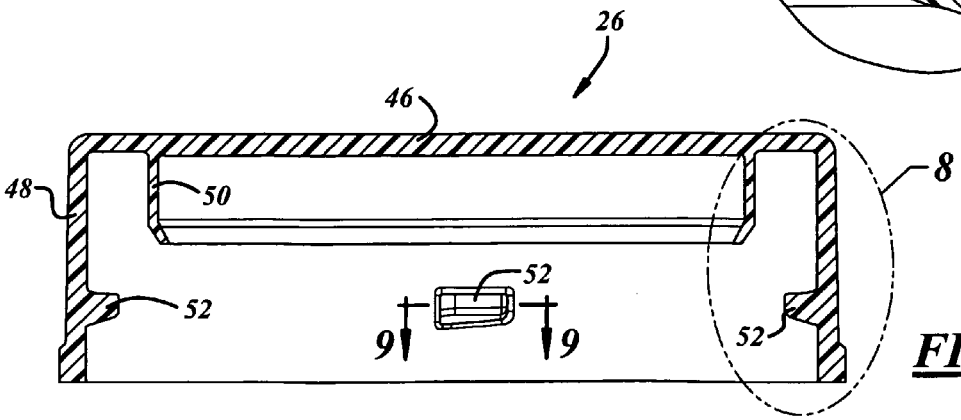
FIG. 6 is a sectional view of the closure in the package of FIGS. 1 and 2.
Figure 7:
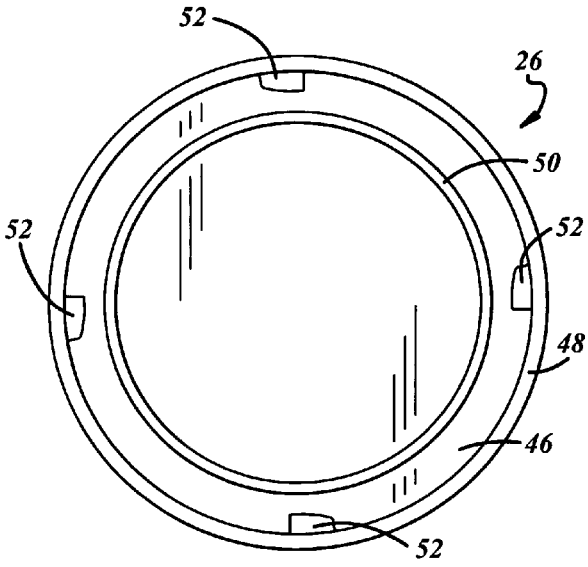
FIG. 7 is a bottom plan view of the closure in FIG. 6.
Figure 8:
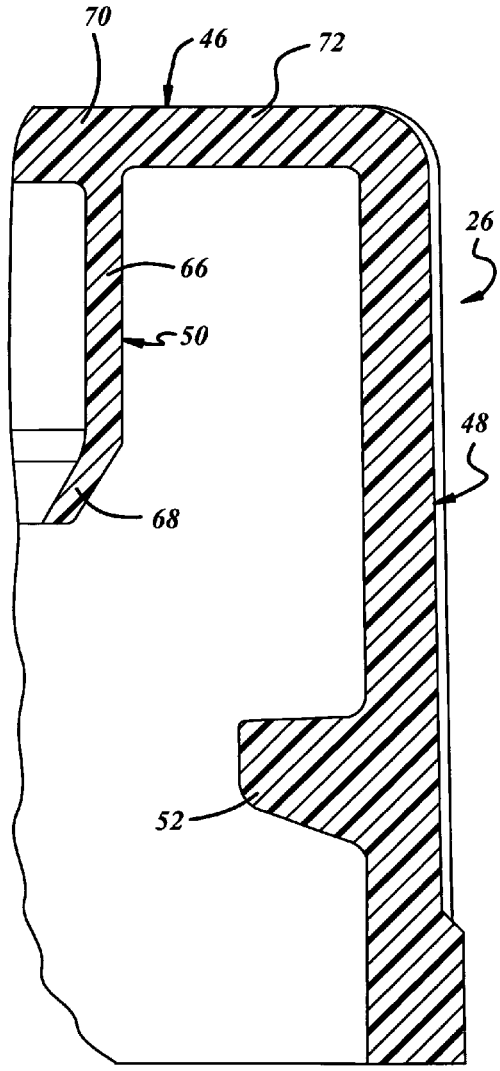
FIG. 8 is a fragmentary sectional view on an enlarged scale of the portion of FIG. 6 within the area 8.
Figure 9:
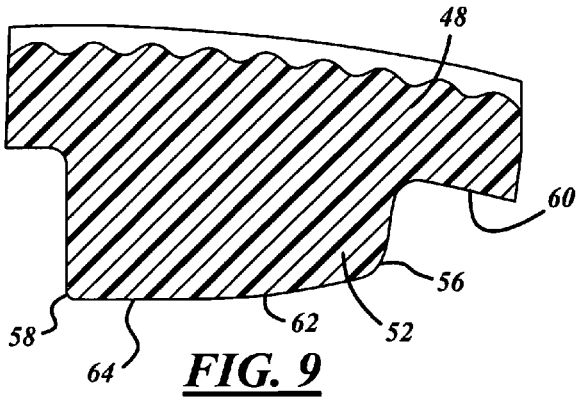
FIG. 9 is a fragmentary sectional view on an enlarged scale taken substantially along the line 9-9 in FIG. 6.

Closure 26 is illustrated in detail in FIGS. 6-9. Closure 26 is of one piece molded plastic construction and includes a base wall 46, an outer first annular wall or skirt 48 and an inner second annular wall 50, both integrally extending from base wall 46. Annular walls 48, 50 preferably are coaxial. First annular 48 has a plurality of angularly spaced internal lugs 52 that correspond in number and angular spacing with external projections 28 on container neck finish 24, specifically four internal lugs 52 at ninety degree spacing corresponding to four external projections 28 in the exemplary embodiment of the disclosure. Referring in particular to FIG. 9, each internal lug 52 has a concave radially inner surface with a clockwise edge 56 and a counterclockwise edge 58 as viewed from closure base wall 46 (FIGS. 6 and 8). Clockwise edge 56 is closer to the inside surface 60 of first annular wall or skirt 48 than is counterclockwise edge 58, as clearly shown in FIG. 9. The radially inner surface of each lug 52 preferably includes a curving first portion 62 of uniform radius of curvature extending from clockwise edge 56 to a position adjacent to but spaced from counterclockwise edge 58, and a flat second portion 64 extending from first portion 62 to counterclockwise edge 58. Edges 56, 58 preferably are rounded. The radially inner convex surface geometry of lugs 52, particularly surface portions 62, helps prevent jamming of the lugs on projections 28 of the container neck finish during automated application of the closure to the container neck finish.

As shown in FIGS. 1 and 2, second annular wall 50 of closure 26 functions as a spring/seal wall in package 20—i.e., functions both to seal the package and to bias the closure away from the container neck finish. Referring to FIG. 8, second annular wall 50 in the closure as molded preferably includes a cylindrical first portion 66 adjacent to and contiguous with closure base wall 46, and a second portion 68 extending from the free end of first portion 66. Second portion 68 preferably is conical in the closure as molded, extending axially away from base wall 46 and radially inwardly from first annular wall or skirt 48. In an exemplary embodiment of the disclosure, second portion 68 is at an angle of about 32° with respect to the axis of the closure. Conical end portion 68 of wall 50 helps prevent interference between wall 50 and container neck finish 24 during automated application of the closure to the container neck finish. Base wall 46 includes a circular first portion 70 within annular wall 50 and an annular second portion 72 between wall 50 and wall 48. First portion 70 preferably is thicker than second portion 72.

During application of the closure to the container neck finish, spring/seal second annular wall 50 is brought into contact with internal surface 38 of container neck finish 24 and closure internal lugs 52 are brought into contact with surfaces 32 of container external projections 28. The spiral geometry of surfaces 32 facilitates application of the closure by clockwise rotation of the closure with respect to the container neck finish (or counterclockwise rotation of the container with respect to the closure). During such application of the closure to the container neck finish, second annular wall 50 slides along internal surface 38, particularly along first portion 40 and onto second portion 42 of internal surface 38. When lugs 52 hit walls 36 of neck finish 24, the lugs are aligned with notches 30 and the closure can be released by the automated equipment. The spring force generated by second annular wall 50 against surface 38 of neck finish 28 urges the lugs into notches 30 to complete the capping operation. At this point, the free edge of wall portion 68 is spaced from surface 38, as best seen in FIG. 2. Inward pressure on spring/seal annular wall 50 from neck finish surface 38 may cause wall portion 66 resiliently to assume a slightly conical geometry, as shown in FIG. 2. Thus, wall portion 66 in assembly with the container is described as being "substantially cylindrical." To remove the closure, the closure is pressed downwardly over neck finish 24 against the spring/seal force of annular wall 50 against surface 38 until lugs 52 clear notches 30. The greater angle of wall portion 42 with respect to the axis of the neck finish applies a greater spring force to the closure to facilitate removal. The closure is then twisted in a counterclockwise direction with respect to the neck finish to remove the closure from the container neck finish.

There thus have been disclosed a child-resistant closure and container package, and a closure and a container for such a package, that fully satisfy all of the objects and aims previously set forth. The disclosure has been presented in conjunction with an exemplary presently preferred embodiment, and a number of modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A child-resistant package that includes:

a container having an open mouth, an angularly spaced array of external projections with notches on undersides of said projections, and a conical internal surface around said mouth, and a closure having a base wall, a first annular wall with angularly spaced internal lugs receivable within said notches, and a second annular wall disposed radially inwardly from said first annular wall and in resilient sealing engagement with said conical internal surface, each of said internal lugs having convex radially inwardly facing surfaces, said convex radially inwardly facing surface of each said lug having a clockwise edge and a counterclockwise edge as viewed from said base wall, said clockwise edge being closer than said counterclockwise edge to an inside surface of said first annular wall, wherein said second annular wall has a substantially cylindrical portion adjacent to said base wall and a conical portion extending from a free end of said substantially cylindrical portion at an angle inwardly from said first wall and away from said base wall, and wherein said closure is of molded plastic construction and said conical portion extends at an angle from said cylindrical portion as molded, wherein during application of said closure to said container neck finish, said second annular wall of said closure slides along said first conical portion of said conical internal surface of said container and onto said second conical portion of said conical internal surface of said container, wherein when said closure is secured to said container neck finish, said second annular wall of said closure sealingly contacts said first conical portion of said conical internal surface of said container, wherein during removal of said closure from said container neck finish, said closure is pushed downwardly over said container neck finish against a spring force of said second annular wall of said closure against said second conical portion of said conical internal surface of said container, wherein said greater angle of said second conical portion facilitates removal of said closure.

2. The package set forth in claim 1 wherein said base wall has a circular first portion within said second annular wall and an annular second portion between said second annular wall and said first annular wall, said first portion being thicker than said second portion.

3. A child-resistant package that includes:

a container having an open mouth, an angularly spaced array of external projections with notches on undersides of said projections, and a conical internal surface around said mouth, and a closure having a base wall, a first annular wall with angularly spaced internal lugs receivable within said notches, and a second annular wall disposed radially inwardly from said first annular wall and in resilient sealing engagement with said conical internal surface, each of said internal lugs having convex radially inwardly facing surfaces, said convex radially inwardly facing surface of each said lug having a clockwise edge and a counterclockwise edge as viewed from said base wall, said clockwise edge being closer than said counterclockwise edge to an inside surface of said first annular wall, wherein said conical internal surface of said container is a compound surface that has a first conical portion adjacent to said mouth and a second conical portion extending from said first portion, said second conical portion being at an angle greater than said first conical portion to an axis of said neck finish, wherein during application of said closure to said container neck finish, said second annular wall of said closure slides along said first conical portion of said conical internal surface of said container and onto said second conical portion of said conical internal surface of said container, wherein when said closure is secured to said container neck finish, said second annular wall of said closure sealingly contacts said first conical portion of said conical internal surface of said container, wherein during removal of said closure from said container neck finish, said closure is pushed downwardly over said container neck finish against a spring force of said second annular wall of said closure against said second conical portion of said conical internal surface of said container, wherein said greater angle of said second conical portion facilitates removal of said closure.

4. A child-resistant closure that includes:

a one-piece molded plastic shell having a base wall, a first annular wall with angularly spaced internal lugs and a second annular wall disposed radially inwardly from said first annular wall, said lugs having convex radially inwardly facing surfaces, said convex radially inwardly facing surface of each said lug having a clockwise edge and a counterclockwise edge as viewed from said base wall, said clockwise edge being closer than said counterclockwise edge to an inside surface of said first annular wall, and wherein said second annularwall as molded having a cylindrical portion adjacent to said base wall and a conical portion extending from an end of said cylindrical portion and angled radially inwardly from said first annular wall away from said base wall, wherein said base wall has a circular first portion within said second annular wall and an annular second portion between said second annular wall and said first annular wall, said first portion being thicker than said second portion.

5. A child-resistant package that includes:

a molded plastic container that includes a neck finish with an open mouth, an angularly spaced array of external projections with notches on undersides of said projections, and a conical internal surface around said mouth, said conical internal surface having a first conical portion adjacent to said mouth and a second conical portion extending from said first conical portion, said second conical portion being at an angle greater than said first conical portion to an axis of said neck finish, and a child-resistant closure that includes a one-piece molded plastic shell having a base wall, a first annular wall with angularly spaced internal lugs and a second annular wall disposed radially inwardly from said first annular wall, wherein during application of said closure to said container neck finish, said second annular wall of said closure slides along said first conical portion of said conical internal surface of said container and onto said second conical portion of said conical internal surface of said container, wherein when said closure is secured to said container neck finish, said second annular wall of said closure sealingly contacts said first conical portion of said conical internal surface of said container, wherein during removal of said closure from said container neck finish, said closure is pushed downwardly over said container neck finish against a spring force of said second annular wall of said closure against said second conical portion of said conical internal surface of said container, wherein said greater angle of said second conical portion facilitates removal of said closure.

6. A child-resistant package that includes:

a container having an open mouth, an angularly spaced array of external projections with notches on undersides of said projections, and a conical internal surface around said mouth, and a closure having a base wall, a first annular wall with angularly spaced internal lugs received within said notches, and a second annular wall disposed radially inwardly from said first annular wall and in resilient sealing engagement with said conical internal surface, each of said internal lugs having convex radially inwardly facing surfaces, said convex radially inwardly facing surface of each said lug having a rounded clockwise edge and a rounded counterclockwise edge as viewed from said base wall, said clockwise edge being closer than said counterclockwise edge to an inside surface of said first annular wall, wherein said radially inwardly facing surface of each said lug has a curving first portion with a uniform radius of curvature from said clockwise edge to a position adjacent to but spaced from said counterclockwise edge and a second portion that is flat from said first portion to said counterclockwise edge.

7. The package set forth in claim 6 wherein said second annular wall has a substantially cylindrical portion adjacent to said base wall and a conical portion extending from said substantially cylindrical portion at an angle inwardly from said first wall and away from said base wall, said conical portion of said second annular wall having an edge remote from said base wall that is spaced from said internal surface of said neck finish.

8. A child-resistant closure that includes:

a one-piece molded plastic shell having a base wall, a first annular wall with angularly spaced internal lugs and a second annular wall disposed radially inwardly from said first annular wall, said lugs having convex radially inwardly facing surfaces, said convex radially inwardly facing surface of each said lug having a rounded clockwise edge and a rounded counterclockwise edge as viewed from said base wall, said clockwise edge being closer than said counterclockwise edge to an inside surface of said first annular wall, wherein said radially inwardly facing surface of each said lug has a curving first portion with a uniform radius of curvature from said clockwise edge to a position adjacent to but spaced from said counterclockwise edge and a second portion that is flat from said first portion to said counterclockwise edge.

* * * * *